US005606722A

United States Patent [19]

Hart et al.

[11] Patent Number: 5,606,722

[45] Date of Patent: Feb. 25, 1997

[54] INTERNAL ELECTRICAL CONTACT FOR MAGNETIC DEVELOPMENT ROLLS

[75] Inventors: Steven C. Hart, Webster; Daniel M. Bray, Rochester, both of N.Y.

[73] Assignee: Xerox Corporation, Stamford, Conn.

[21] Appl. No.: 533,577

[22] Filed: Sep. 25, 1995

[51] Int. Cl.[6] ..... G03G 15/09

[52] U.S. Cl. ..... 399/270

[58] Field of Search ..... 355/245, 251, 355/253, 261, 263, 274; 118/647, 649, 657, 658

[56] References Cited

U.S. PATENT DOCUMENTS

| | | | |
|---|---|---|---|
| 4,656,964 | 4/1987 | Kano et al. | 355/251 X |
| 5,283,619 | 2/1994 | Nomura et al. | 355/261 |
| 5,360,940 | 11/1994 | Hays | 355/261 X |
| 5,394,225 | 2/1995 | Prker | 118/647 |
| 5,410,390 | 4/1995 | Miura et al. | 355/274 X |
| 5,428,429 | 6/1995 | Fletcher | 355/274 X |
| 5,502,549 | 3/1996 | Hart et al. | 355/245 |

*Primary Examiner*—Sandra L. Brase

[57] ABSTRACT

A magnetic brush developer roll structure comprising a stationary magnet assembly including a magnet assembly shaft supporting magnet material. Bearings carried by the shaft, in turn, support a rotatable shell or tube forming the outer member of the roll structure. The bearings together with the shell or tube delineate an essentially sealed cavity in which one or more electrical contact brushes are disposed. The brush rubs against an inner wall of the shell or tube and provides an electrical path thereto. Using a plurality of brushes results in improved reliability.

10 Claims, 4 Drawing Sheets

INTERNAL ELECTRICAL CONTACT FOR MAGNETIC DEVELOPMENT ROLLS

BACKGROUND OF THE INVENTION

This invention relates generally to the rendering of latent electrostatic images visible. More particularly, the invention relates to a method and apparatus for commutating power to the outer surface of a developer or toner delivery member.

The invention can be utilized in the creation of powder images through the use of xerography. In the practice of conventional xerography, it is the general procedure to form electrostatic latent images on a xerographic surface by first uniformly charging a photoreceptor. The photoreceptor comprises a charge retentive surface. A uniformly charged photoreceptor is selectively dissipated in accordance with a pattern of activating radiation corresponding to original images. The selective dissipation of the charge leaves latent charge patterns on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

A common device for developing powder images formed on a charge retentive surface such as a photoreceptor comprises a magnetic brush toner delivery roll. One such toner delivery device comprises a magnet structure which is stationarily supported using a magnet assembly shaft. A bearing supported by the shaft, in turn, rotatably supports a rotatable shell or tube. Creating a reliable electrical contact to the shell/tube of a magnetic development roll has traditionally required the use of bearings with electrically conductive grease when making the electrical contact through the magnet assembly shaft. Conductive greases cost more than standard greases and do not lubricate as well.

Another type of magnetic brush developer roll utilizes a rotary magnet and shaft assembly in combination with a stationarily supported shell or tube. In order to establish an electrostatic field in the development in this type of developer roll structure, a brush or spring type contact engages the magnetic drive roll shaft. This type of arrangement is subject to brush or spring contact failure due to contamination and potential damage during manufacture and/or servicing. Also, fibers loosened from a contact brush can short out corona devices and have a adverse affect on if they contact the photo receptor.

BRIEF SUMMARY OF THE INVENTION

In accordance with the present invention, there is provided a magnetic brush developer roll structure comprising a stationary magnet assembly including a magnet assembly shaft supporting magnet material. Bearings carried by the shaft, in turn, support a rotatable shell or tube. The shell or tube forms the outer member of the roll structure. The bearings and the shell or tube delineate an essentially sealed cavity in which one or more electrical contact brushes are disposed. The brush rubs against an inner wall of the shell or tube and provides an electrical path to the shell from a power supply operatively connected to the shaft. Using a plurality of brushes results in improved reliability.

Alternatively, the electrical contact brush may rub against the shaft. In the embodiment where the electrical brush rubs against the inner wall of the shell or tube the brush is supported by the shaft while in the embodiments where the brush rubs against the shaft, the brush is supported by either the outer race of the bearing structure or the shell.

DETAILED DESCRIPTION OF THE PREFERRED EMBODIMENT OF THE INVENTION

Figure 2:
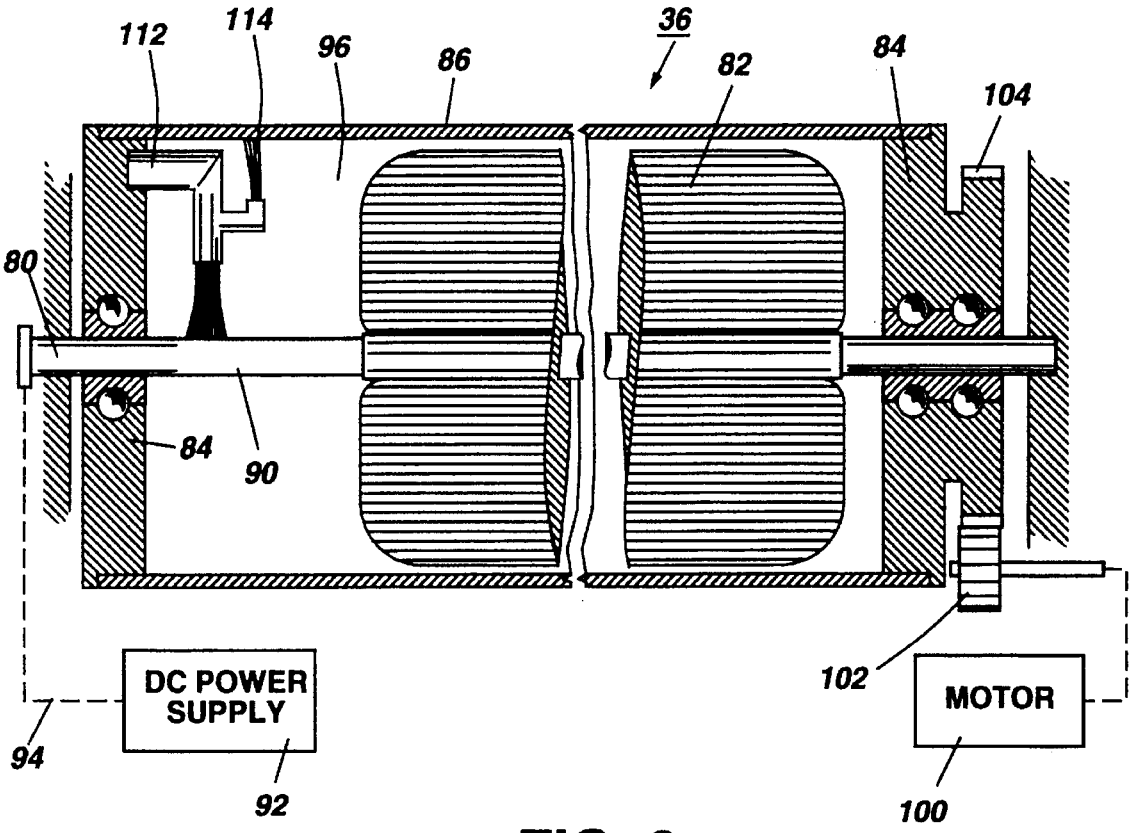
FIG. 2 is a fragmentary view, partly in cross section, of a development structure according to a modified embodiment of the invention.

For a general understanding of the features of the present invention, reference is made to the drawings. In the drawings, like reference numerals have been used throughout to identify identical elements. FIG. 2 schematically depicts an electrophotographic printing machine 9 incorporating the features of the present invention therein.

Referring to FIG. 2 of the drawings, the electrophotographic printing machine employs a belt 10 having a photoconductive surface 12 deposited on a conductive substrate, not shown. Belt 10 moves in the direction of arrow 16 to advance successive portions of photoconductive surface sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive belt passes through a charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through an imaging station B. At imaging station B, a document handling unit, indicated generally by the reference numeral 28, is positioned over platen 30 of the printing machine. Document handling unit 28 sequentially feeds documents from a stack of documents placed by the operator faceup in a normal forward collated order in a document stacking and holding tray. A document feeder located below the tray forwards the bottom document in the stack to a pair of take-away rollers. A bottom sheet 31 is then fed by the rollers to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document. Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet 31 is placed in proper lateral edge alignment. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp.

After fusing, the copy sheets are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. The paper path signature analysis apparatus of the present invention can be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

Figure 1:
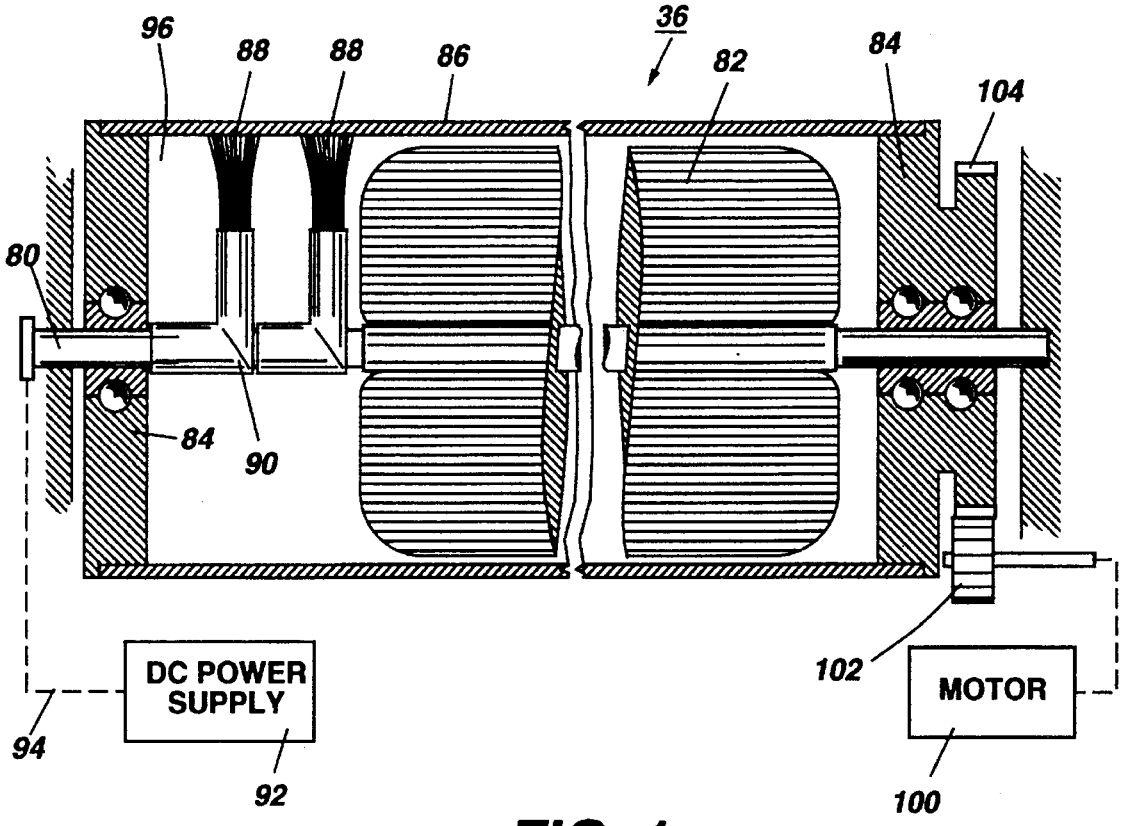
FIG. 1 is a fragmentary view, partly in cross section of a development structure according to the present invention.

Attention is now directed to FIG. 1 wherein the development roll or toner delivery structure 36 is illustrated in greater detail with particular emphasis on the novel aspects of the present invention. The development roll structure 38 is identical to the structure 36.

As disclosed in FIG. 1 the development roll structure 36 comprises a stationary shaft 80 upon which is stationarily mounted a magnet assembly 82. A pair of bearing structures 84 and 85 are carried by the shaft 80. A rotatable shell or tube 86 is supported for rotation in a conventional manner but the bearing structures 84, 85. A first slip-ring like brush member 88 fabricated from conductive fiber is mounted on a metallic or conductive plastic holder 89 secured to the shaft 80. A second brush 90 and a brush holder 91 which are identical to the brush and brush holder 88 and 89 are utilized to provide redundant electrical paths from the shaft 80 to the shell 86 for improved reliability.

A source of electrical power 92 is operatively secured to the stationary shaft via a lead 94. As can be seen, a voltage is applied to the shell via the magnet shaft, the brush and brush holder.

A motor 100 is operatively connected in a conventional manner via a gears 102 and 104 to the shell or tube 86 through one of the bearing structures 84. Rotation of the shell 86 serves to convey toner particles from a sump, not shown, to a development zone 102 (See FIG. 2).

The bearings 84, 85 cooperate with the shell 86 to form or delineate an essentially sealed cavity 96 in which the brushes 88, 89 and conductive holders 90, 91 are disposed.

Figure 3:
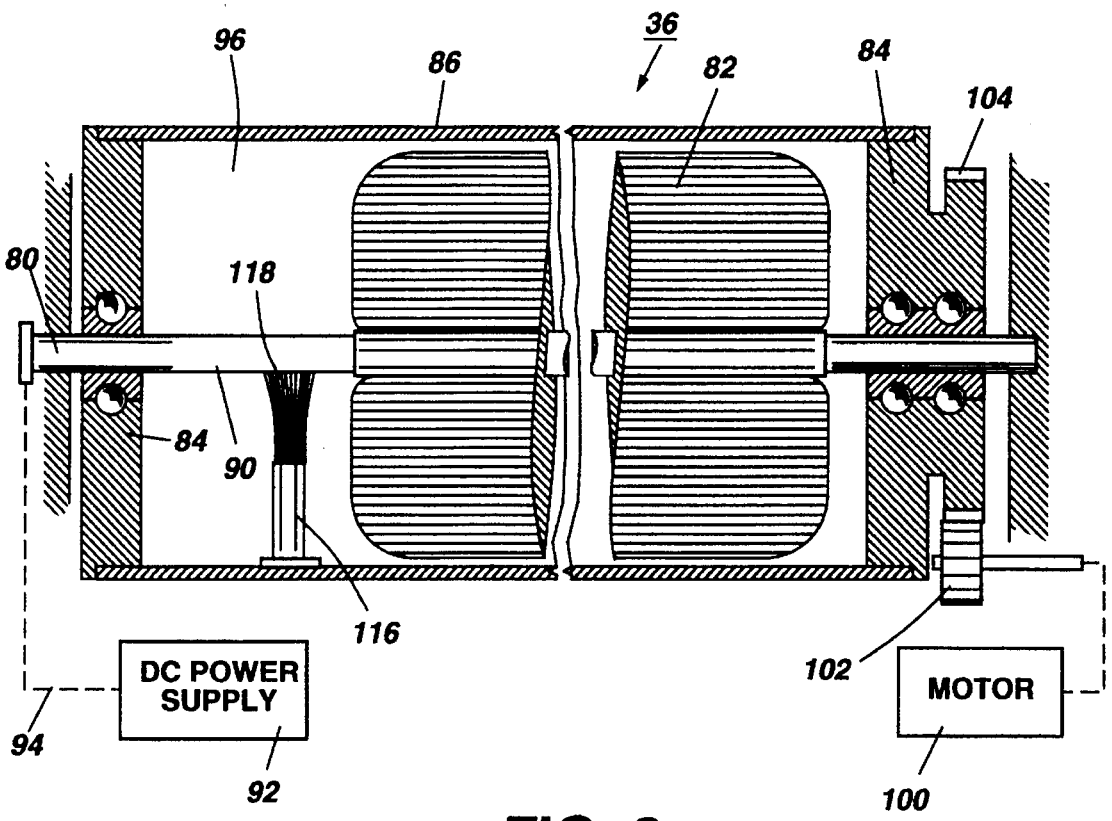
FIG. 3 is a fragmentary view, partly in cross section, of a development structure according to another modified embodiment of the invention.
Figure 4:
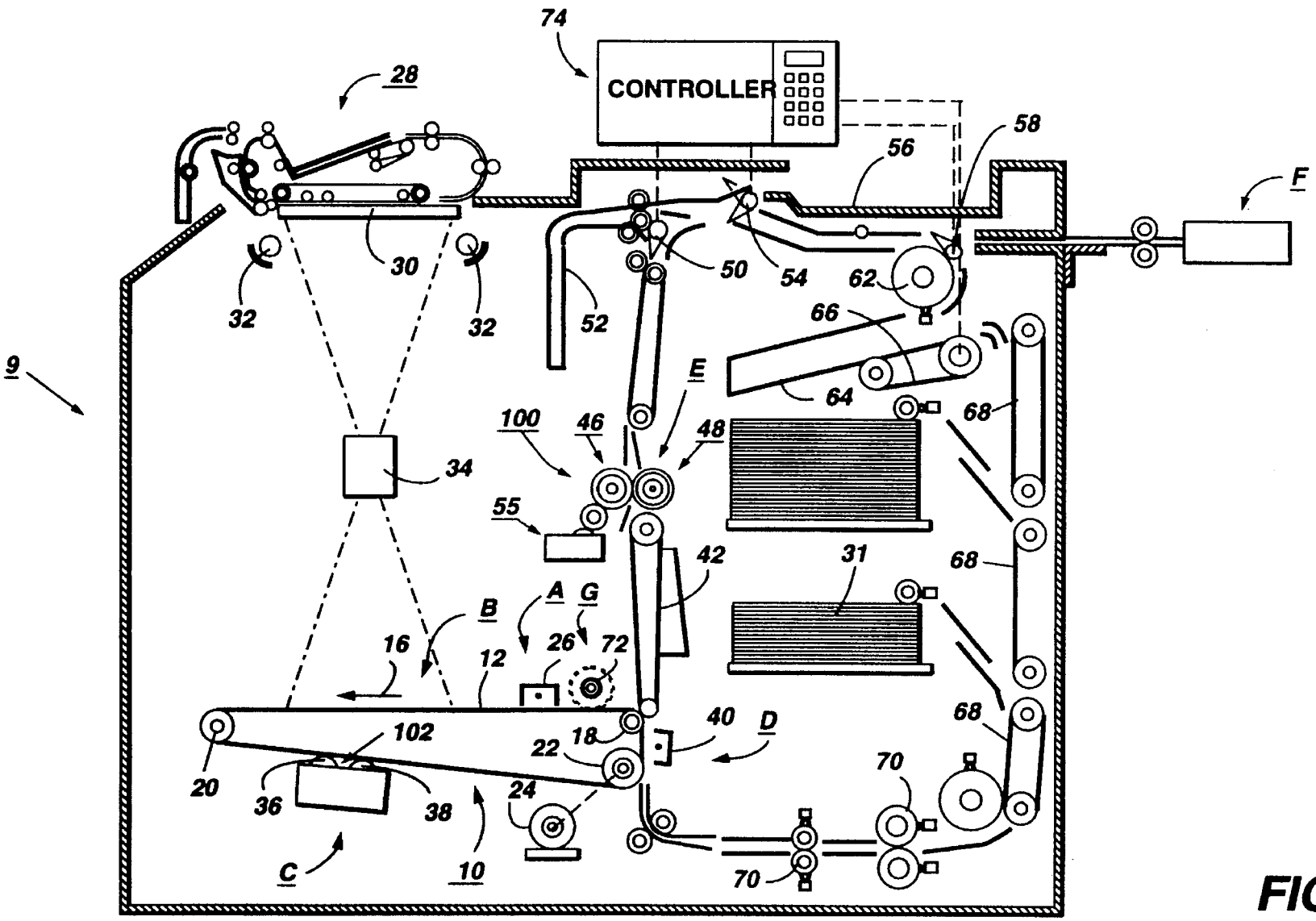
FIG. 4 is schematic illustration of a printing apparatus of the prior art in which the present invention may be utilized.

A modified embodiment of the developer structure illustrated in FIG. 1 is depicted in FIG. 2. Common elements between FIGS. 1 and 2 are designated by the same reference characters. As disclosed in FIG. 2, a developer structure 37 comprises a conductive fiber brush 110 and a metallic or conductive plastic brush holder 112. The brush and holder combination of FIG. 2 are functionally identical to the corresponding members of FIG. 1. The brush holder is electrically connected to the tube or outer shell 86—and the conductive brush fibers contact the shaft 80. The brush holder is mounted to either the outer race 84 of the bearing structure as illustrated in FIG. 2 or mounted directly to the inside of the tube or shell 86 as illustrated in FIG. 3. In the embodiment of FIG. 2, an electrical connection 114 is provided in the situation where the outer race 84 is non-conductive. A plurality of brushes may be provided as with the embodiment of FIG. 1 for the purpose of improved reliability. In the embodiment of FIG. 3, the brush holder is depicted by reference character 116 and the brush fibers by the reference character 118.

It can now be seen, that by providing an essentially sealed cavity for the brush structure, the brush is substantially free of contamination from foreign particles. Moreover, in the event that one of the conductive fibers detach from the brush, such fibers will not damage other components of the image creation apparatus because they will be confined to the cavity 96.

What is claimed is:

1. A developer structure for presenting toner to latent electrostatic images, said structure comprising:

an electrically conductive; shaft member;

a magnet structure carried by said shaft;

non-electrically conductive bearing structure supported by said shaft;

a tubular, electrically conductive shell supported by said bearing structure;

means for moving said electrically conductive shell in an endless path;

an essentially sealed cavity in said developer structure; and an electrical slip-ring like structure supported entirely in said cavity for providing an electrical path between said electrically conductive shaft and said electrically conductive shell.

2. Apparatus according claim 1 wherein said electrical slip-ring like structure comprises an electrically conductive fiber brush.

3. Apparatus according claim 2 wherein said, shell structure and said bearing structure delineate said essentially sealed cavity.

4. Apparatus according to claim 2 wherein said electrically conductive brush includes a conductive brush holder supported in said cavity.

5. Apparatus according to claim 4 wherein said holder is attached to said shaft and said brush fibers contact said shell.

6. Apparatus according to claim 4 wherein said holder is attached to an outer race of said bearing structure and said brush contacts said shaft.

7. Apparatus according to claim 4 wherein said holder is carried by said shell and said brush fibers contact said shaft.

8. Apparatus according claim 1 wherein said, shell structure and said bearing structure delineate said essentially sealed cavity.

9. Apparatus according to claim 1 wherein said electrical slip-ring like structure comprises a plurality of conductive fiber brushes for providing redundant slip-ring like structures.

10. Apparatus according to claim 9 wherein said holder is attached to an outer race of said bearing structure and said brush contacts said shaft.

* * * * *